US005798682A

United States Patent [19]

Kim et al.

[11] Patent Number: 5,798,682

[45] Date of Patent: Aug. 25, 1998

[54] SYNCHRONOUS CABLE COUPLING DEVICE OF FLYBACK TRANSFORMER

[75] Inventors: Myung Hwan Kim; Tae Woo Goo, both of Kyongki-do, Rep. of Korea

[73] Assignee: Samsung Electro-Mechanics Co., Ltd., Kyongki-do, Rep. of Korea

[21] Appl. No.: 691,961

[22] Filed: Aug. 5, 1996

[30] Foreign Application Priority Data

| | | | |
|---|---|---|---|
| Nov. 21, 1995 | [KR] | Rep. of Korea | 1995 34687 |
| Nov. 21, 1995 | [KR] | Rep. of Korea | 1995 34683 |
| Nov. 21, 1995 | [KR] | Rep. of Korea | 1995 42671 |

[51] Int. Cl.[6] ..... H01F 27/02; H01F 27/29; H01F 27/30

[52] U.S. Cl. ..... 336/96; 336/175; 336/192; 336/223

[58] Field of Search ..... 336/96, 223, 192, 336/173, 174, 175, 65

[56] References Cited

U.S. PATENT DOCUMENTS

| | | | |
|---|---|---|---|
| 3,268,843 | 8/1966 | Popp | 336/175 |
| 4,746,891 | 5/1988 | Zylstra | 336/175 |
| 5,602,519 | 2/1997 | Kim | 336/175 |

FOREIGN PATENT DOCUMENTS 53-11928 1/1978 Japan .

*Primary Examiner*—Thomas J. Kozma

*Attorney, Agent, or Firm*—Lowe, Price, LeBlanc & Becker

[57] ABSTRACT

A coupling device of synchronous cable for making the frequency to be mutually coincided by connecting a frequency of induced voltage generated from FBT to a set. The technical construction is made such that coupling holes 71*a*, 71*b* are defined at terminal piece receiving means 70 rearward both sides of rectangular shape so as to be coupled with coupling pieces 52*a*, 52*b* stood at low voltage bobbin 51 bottom both sides of the FBT 50, a core inserting opening 73 is defined in which external surface gap 61 portion of the ferrite core 60 is inserted and located at frame 72 center of the terminal piece receiving means 70, and a terminal piece inserting groove 74 is defined in which a synchronous terminal piece 80 is inserted into the core inserting opening 73 external circumference; and terminal pin inserting holes 75*a*, 75*b* are perforated to bottom of the supporting bracket 90 downwardly stood at the frame 72 forward both sides of the terminal piece receiving means 70 so that terminal pins 81*a*, 81*b* of the synchronous terminal piece are inserted through into the terminal pin inserting holes 75*a*, 75*b* whereby supported and fixed; and the terminal pins 81*a*, 81*b* are integrally stood downwardly at forward both sides of the synchronous terminal piece inserted into the terminal piece inserting groove 74 so as to be coupled on a PCB 100 after inserting through into interior of the terminal inserting holes 75*a*, 75*b* of the terminal piece receiving means 70.

5 Claims, 5 Drawing Sheets

SYNCHRONOUS CABLE COUPLING DEVICE OF FLYBACK TRANSFORMER

BACKGROUND OF THE INVENTION

The present invention relates to a coupling device of synchronous cable for making the frequency to be mutually coincided by connecting a frequency of induced voltage generated from FBT to a set, in a flyback transformer (hereinafter call as "FBT") which is a high voltage generating device feeding a high voltage to a Brown tube (cathode-ray tube) of television(TV) set or computer monitor, and more particularly, to a synchronous cable coupling device of FBT which is made such that a terminal piece receiving means to be inserted with synchronous terminal pieces to central gap portion of ferrite core to forward wall surface of case of FBT provided to inside with ferrite core is fixed, not only a terminal piece inserting holes are perforated at both sides of bottom of the terminal piece receiving means whereby both sides terminal pieces are inserted into them so as to be coupled with PCB, due to synchronous cable winding pins are stood to forward both sides of pin terminal portion of low voltage bobbin whereby synchronous cable is wound and then this is to be coupled with PCB, either a separate synchronous cable is connected on FBT ferrite core for absorbing an electronic wave according to synchronous signal of FBT, without providing a shield metal, a synchronous cable winding pin is stood on low voltage bobbin, or else not only the synchronous cable is made to be able to easily and simply provide by simple operation which inserts a synchronous terminal piece executing a synchronous cable role to terminal piece receiving means, and the synchronous terminal piece is made to be coupled to the terminal piece receiving means of ferrite core in firm state whereby an absorption of electronic wave radiation by synchronous terminal piece is securely made and simultaneously a coupling operation of the synchronous terminal is automatized so that a workability and productivity can be improved.

In general, the synchronous cable provided by connecting to FBT executes a role for integrally making mutually frequencies by connecting frequency of induced voltage generated at FBT to a set in order to make a frequency of various operation signals such as monitor and the like and an operation frequency of FBT being a part of power supply to be integral.

In a conventional FBT related to such technique, as shown in FIG. 1, it is made by a structure in which an epoxy resin being an insulation resin is filled to be molded between high and low voltage bobbins (not shown) at a state that the high and low voltage bobbins wound with coils are contained within interior of FBT case 10 so as to be superposed, and "C"-shaped ferrite core 20 is inserted and fixed with maintaining a predetermined gap one another to top and bottom of the FBT case 10 whereby connected with a set such as monitor and the like through the high voltage cable so as to supply a high voltage.

The FBT having a structure as these generates a high voltage through coils wound to high and low voltage bobbins, so that the high voltage generated at this moment is supplied to a set such as monitor and the like through an anode cable.

And, in accordance with the ferrite core 20 provided to FBT as above, a radiation of the electronic wave is necessarily produced by internal and external gaps 21, 22 between top and bottom cores upon applying of power within FBT, and the electronic wave of the internal gap 21 among the electronic waves generated from the internal and external gaps 21, 22 of the ferrite core 20 becomes absorbed through the coil wound to the high voltage and low voltage bobbins of interior of FBT case 10, and the electronic wave of exterior generated from the external gap 22 of the ferrite core 20 is emitted as it is.

On the other hand, in a coupling method of a conventional FBT synchronous cable, as shown in FIG. 2, a synchronous cable 30 is made to be drawn out as much as a predetermined length at a side of the ferrite core 20 provided to FBT case 10 in a state being plaited by a heat-shrinkable tube 31 so as to be connected on a printing circuit board.

However, in FBT as above, there has been many problems that a setting work of the synchronous cable 30 becomes cumbersome due to the synchronous cable 30 is made to use by plaiting the heat-shrinkable tube 31 by manual work between the ferrite cores 20 provided to top and bottom of FBT case 10, and not only the working numbers become excessively many due to this is made to execute by a manual working, but also a badness is frequently produced upon a connecting work of the synchronous cable due to operation for making to indicate one by one to external cable for discrimination of component of the synchronous cable 30, and the synchronous cable 30 fixed in a state being plaited to the ferrite core 20 is made to be easily moved whereby the frequency of voltage induced within the FBT can not be made to be coincided with the set as it should, accordingly an electric property of the product is decreased.

OBJECT AND SUMMARY OF THE INVENTION

Therefore, the present invention is directed to improve such conventional various problems as above, and it is an object of the present invention to provide a synchronous cable coupling device of FBT in which a frequency of an induced voltage generated from FBT is made to be stably drawn out, and a separate synchronous cable is connected on the FBT ferrite core for an electronic wave absorption in response to the synchronous signal of FBT, or without requiring to provide a shield metal, not only the synchronous cable is made to be able to simply and easily provide by a simple operation inserting a synchronous terminal piece executing a synchronous cable role to a terminal receiving means, but also the synchronous terminal piece is made to be coupled to the terminal piece receiving means of the ferrite core in firm state whereby an absorption of the electronic wave radiation by the synchronous terminal piece is surely made and simultaneously a coupling work of the synchronous terminal piece is automatized whereby a workability and productivity can be improved, and particularly a frequency of operating signal of the set and an operating frequency of FBT can be further more effectively coincided.

Another object of the present invention is to provide a synchronous cable coupling device of FBT which prevents a movement of FBT ferrite core upon coupling the synchronous terminal piece and simultaneously capable of effectively cut off the radiation of electronic wave generated from external gap of the ferrite core through a terminal piece receiving means internally inserted with the synchronous terminal piece.

Still other object of the present invention is to provide a synchronous cable coupling device of FBT in which a synchronous cable is coupled to a cable winding pin of low voltage bobbin in a firm state whereby an absorption of electronic wave by the synchronous cable can be surely made.

As a technical method for attaining above object, the present invention is an article to provide a synchronous cable coupling device made by comprising:

a terminal receiving means in which coupling holes are formed to rearward both sides so as to be coupled with coupling pieces stood at both sides of low voltage bobbin bottom of FBT, core inserting opening to be inserted with external gap portion of ferrite core at frame center, and terminal piece inserting groove to be inserted with synchronous terminal piece to said core inserting opening external circumference;

a supporting bracket in which terminal piece inserting hole is perforated at bottom of forward both sides of the terminal piece receiving means so that terminal pin of the terminal piece is inserted through the terminal piece inserting hole whereby supported and fixed; and synchronous terminal pieces in which terminal pieces are integrally and downwardly stood to forward both sides of terminal portion inserted into the terminal piece inserting groove so as to be coupled on PCB.

And, the present invention is made to provide a synchronous cable coupling device made by comprising such that synchronous cable winding pins are respectively stood to terminal portion forward both sides provided with terminal piece of the low voltage bobbin whereby both end portions of the synchronous cable contacted with down side bottom surface of the ferrite core are wound to the synchronous cable winding pin, and said synchronous cable winding pin is made to be coupled on PCB.

DETAILED DESCRIPTION OF THE PREFERRED EMBODIMENTS

Hereinafter, the preferred embodiment of the present invention will be described more in detail with reference to the accompanying drawings.

Figure 1:
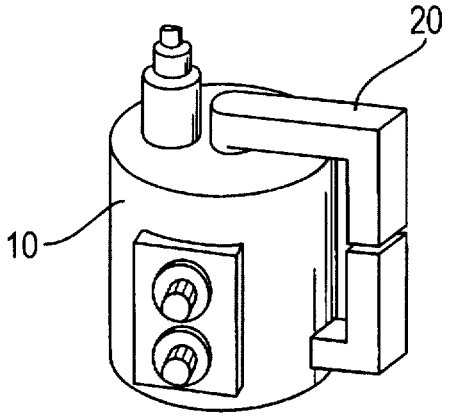
FIG. 1 PRIOR ART
FIG. 1 is a perspective view of structure of general flyback transformer FBT.
Figure 2:
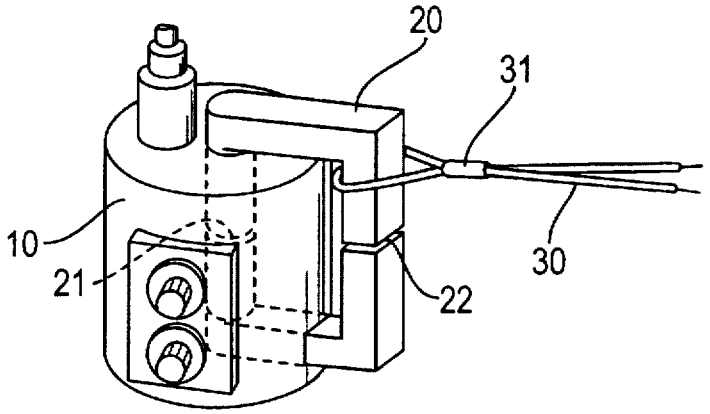
FIG. 2 PRIOR ART
FIG. 2 is a perspective view showing a conventional connecting method of synchronous cable to the flyback transformer.
Figure 3:
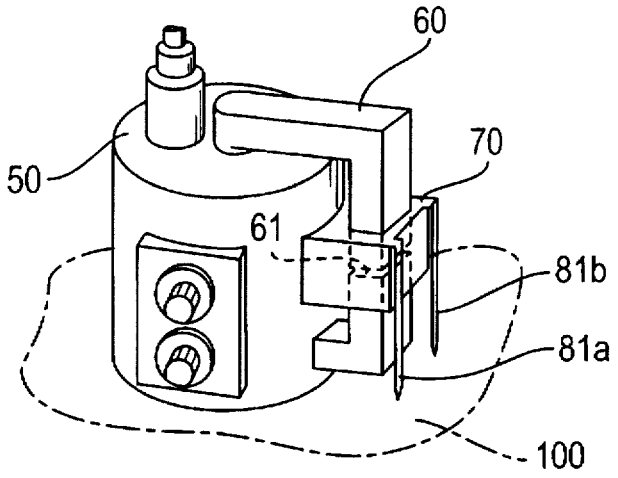
FIG. 3 is a schematic perspective view of FBT provided with synchronous cable coupling device of the flyback transformer FBT in accordance with the present invention.
Figure 4:
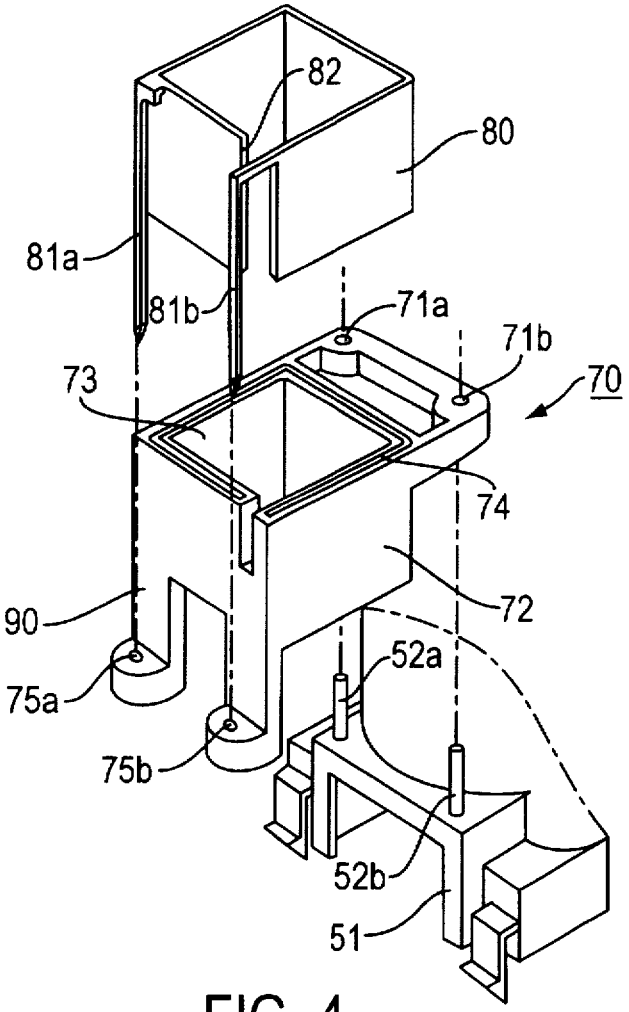
FIG. 4 is an exploded perspective view of an essential part of the synchronous cable coupling device of the flyback transformer FBT which is the present invention.

FIG. 3 is a schematic perspective view of FBT provided with synchronous cable coupling device of FBT in accordance with the present invention, and FIG. 4 is an exploded perspective view of an essential part of the synchronous cable coupling device of FBT which is the present invention, and the synchronous cable coupling device of the present invention comprises: a terminal piece receiving means 70 for receiving synchronous terminal pieces 80, a supporting bracket 90 for supporting and fixing a terminal pin of the synchronous terminal piece, and synchronous terminal pieces for drawing out an induced voltage.

An epoxy resin being an insulation resin is filled and molded between high voltage and low voltage bobbins and FBT case in a state that the high voltage and low voltage bobbins 51 wound with coils within interior of FBT 50 is contained within interior so as to be superposed, and "C"-shaped ferrite core is inserted and fixed with maintaining a predetermined gap one another at case top and bottom of the FBT 50.

And, coupling holes 71*a*, 71*b* are defined at the terminal piece receiving means 70 rearward both sides of rectangular shape so as to be coupled with coupling pieces 52*a*, 52*b* stood at low voltage bobbin 51 bottom both sides of the FBT 50, a core inserting opening 73 is defined in which external surface gap 61 portion of the ferrite core 60 is inserted and located at frame 72 center of the terminal piece receiving means 70, and a terminal piece inserting groove 74 is defined in which a synchronous terminal piece 80 is inserted to the core inserting opening 73 external circumference.

And, terminal pin inserting holes 75*a*, 75*b* are perforated to bottom of the supporting bracket 90 downwardly stood at the frame 72 forward both sides of the terminal piece receiving means 70 so that terminal pins 81*a*, 81*b* of the synchronous terminal piece are inserted through to the terminal pin inserting holes 75*a*, 75*b* whereby supported and fixed.

The terminal pins 81*a*, 81*b* are integrally stood downwardly at forward both sides of the synchronous terminal piece inserted within the terminal piece inserting groove 74 so as to be coupled on a PCB 100 after inserting through into interior of the terminal inserting holes 75*a*, 75*b* of the terminal piece receiving means 70.

The terminal piece receiving means 70 provided to forward wall surface of the FBT 50 may be formed by same injected matter with a case of FBT, and the synchronous terminal piece 80 inserted into interior of the terminal piece inserting groove 74 of the terminal piece receiving means 70 is formed with a cut out portion being cut out at one side is formed so as to be easily inserted and fixed into interior of the terminal piece inserting groove 74.

And, the synchronous terminal piece 80 being inserted into interior of the terminal piece inserting groove 74 of the terminal piece receiving means 70 and drawing out an induced voltage is made to be structured by a shield metal being a conductor, and the external gap 61 portion of the ferrite core 60 is located at the core inserting opening 73 interior side formed within interior of the terminal piece receiving means 70 whereby cutting off the radiation of electronic wave.

Explaining an operation and effect of the present invention made by a structure as above, it will be as follows.

As shown in FIG. 3 and FIG. 4, an epoxy resin being an insulation resin is filled and molded between the high voltage and low voltage bobbins and FBT 50 case in a state that the high voltage and low voltage bobbins 51 wound with coils are contained within interior of the FBT 50 so as to be superposed one another so that high voltage is induced with maintaining an insulated state so as to supply this to interior of a set such as monitor, and on the other hand, "C"-shaped ferrite core 60 is inserted to top and bottom of the FBT 50 case with maintaining a predetermined gap each other so as to be fixed, therefore noise of electronic wave generated upon inducing a high voltage can be eliminated.

The external surface gap 61 portion of the ferrite core 60 inserted to the FBT 50 makes to cut off the radiation of electronic wave by which the external gap 61 portion of the ferrite core 60 is located at inner side of the core inserting opening 73 formed to interior of the terminal piece receiving means 70 fixed thereto.

At this moment, the terminal piece inserting groove 74 is formed at the core inserting opening exterior circumference of the terminal piece receiving means 70 so that the synchronous terminal piece 80 is inserted thereinto and fixed thereto, and accordingly the synchronous terminal piece 80 structured by a shield metal is simply and easily inserted into interior of the terminal piece inserting groove 74 of the terminal piece receiving means 70 so as to draw out the induced voltage generated from the FBT 50.

On the other hand, the terminal receiving means 70 is made such that in a state that the coupling holes 71*a*, 71*b* are perforated at its rearward both sides and inserted to the coupling pieces 52*a*, 52*b* integrally stood at the low voltage bobbin 51 bottom both sides of the FBT 50 whereby made to be firmly fixed, the terminal pin inserting holes 75*a*, 75*b* are perforated at its bottom portion via the supporting bracket 90 integrally and downwardly stood with this at forward both sides of the terminal receiving means 70 whereby the synchronous terminal pieced 80 is inserted into interior of the terminal piece inserting groove 74 and simultaneously the terminal pins 81*a*, 81*b* provided at forward both sides of the synchronous terminal piece 80 are inserted into the terminal pin inserting holes 75*a*, 75*b* so as to be coupled with the PCB 100.

According to this, the terminal piece receiving means 70 located with external surface gap portion 61 of the ferrite core 60 internally inserts and fixes the synchronous terminal piece 80 into interior of the terminal piece receiving means 70 as shown in FIG. 4, and then the terminal pins 81*a*, 81*b* executing a synchronous cable role of its forward is made to be easily coupled with PCB 100, and the external electronic wave generated from the external surface gap 61 of the ferrite core 60 can be effectively emitted to exterior through the terminal pins 81*a*, 81*b* of the terminal piece 80.

Figure 5:
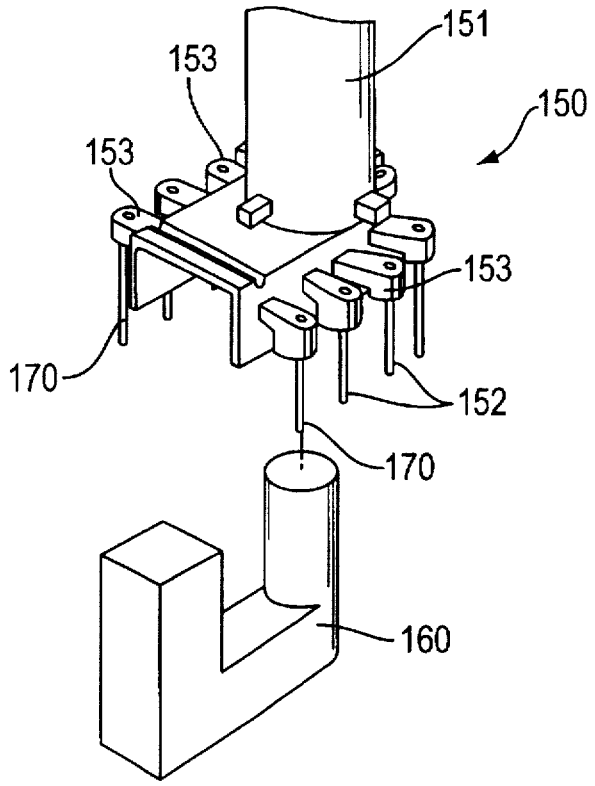
FIG. 5 is a perspective view of an essential part of the synchronous cable coupling device in accordance with another embodiment of the present invention.

On the other hand, FIG. 5 is a view showing a synchronous cable coupling device of FBT in accordance with another embodiment of the present invention.

Its structure is made such that the synchronous cable winding pins 170 are respectively stood at pin terminal 153 portion forward both sides provided with terminal pins 152 of low voltage bobbin 151 of FBT 150 whereby both ends of synchronous cable 180 contacted with down side bottom of ferrite core 160 are wound to the synchronous cable winding pins 170, and thereby the synchronous cable winding pins are integrally coupled on PCB 190 with terminal pins 152 of the low voltage bobbin 151.

Figure 6:
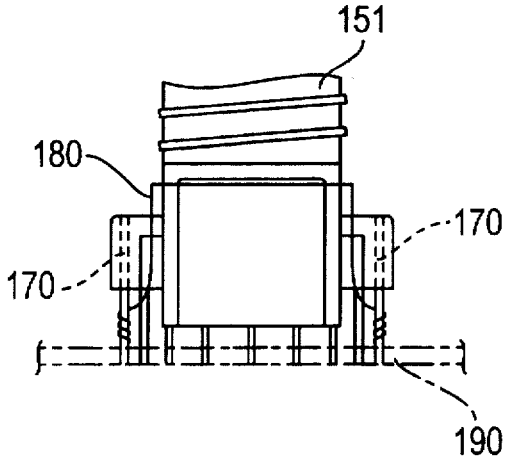
FIG. 6 is a front cross sectional view showing a state that the synchronous cable is coupled on a low voltage bobbin of FIG. 5.

In accordance with the synchronous cable coupling device made by a structure as above, as shown in FIG. 5 and FIG. 6, the synchronous cable winding pins 170 of the pin terminal portions 153 provided at low voltage bobbin 151 forward both sides of the FBT 150 are made to be drawn in with the synchronous cable 180 on both side synchronous cable winding pins 170 so as to wind and then, the synchronous cable winding pins 170 wound with synchronous cable 180 are made to be inserted on PCB 190 integral with terminal pins 152 of the low voltage bobbin 151 upon assembling a set, so that an electronic wave generated from FBT 150 can be easily absorbed to the synchronous cable 180.

At this moment, the synchronous cable 180 is made such that upon winding this to the synchronous cable winding pins 170, bottom side portion of bottom surface portion of the ferrite core 160 provided to external side of the low voltage bobbin 151 is contacted by passing through in a state of pressing the synchronous cable 180, whereby becoming to effectively transfer the synchronous signal.

According to this, the synchronous cable winding pins 170 are respectively stood on both side pin terminal portions 153 of the low voltage bobbin 151 upon manufacturing the low voltage bobbin 151, and then a coupling of the synchronous cable can be completed by a simple operation coupling to PCB 190 by winding the synchronous cable 180 thereto.

Figure 7:
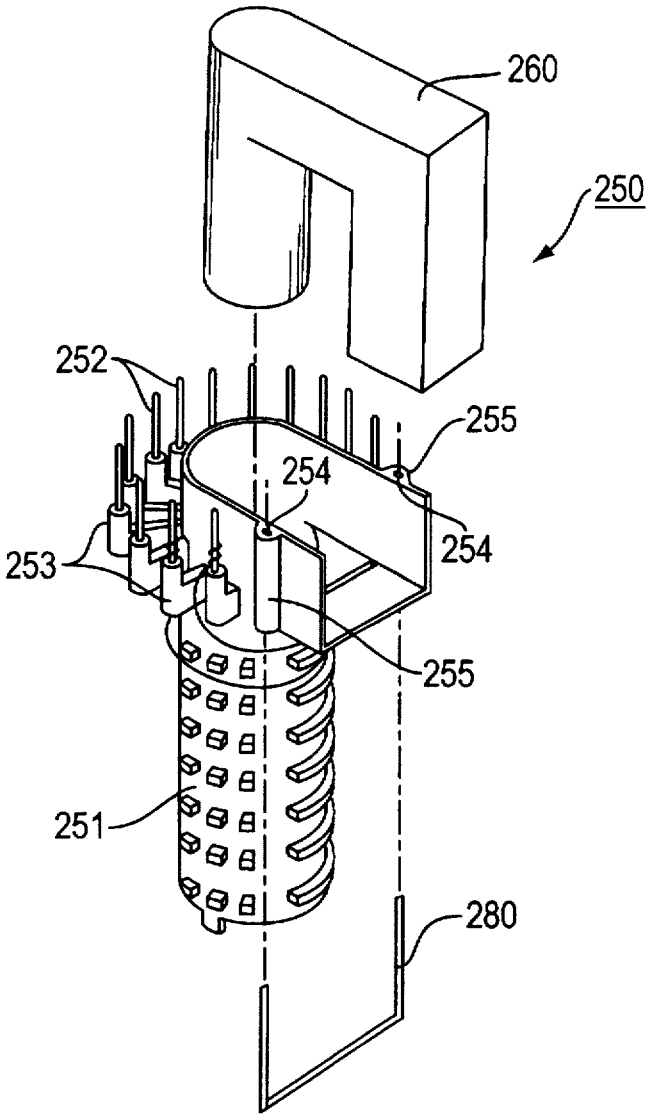
FIG. 7 is a perspective view of an essential part showing a synchronous cable coupling device in accordance with still other embodiment of the present invention.
Figure 8:
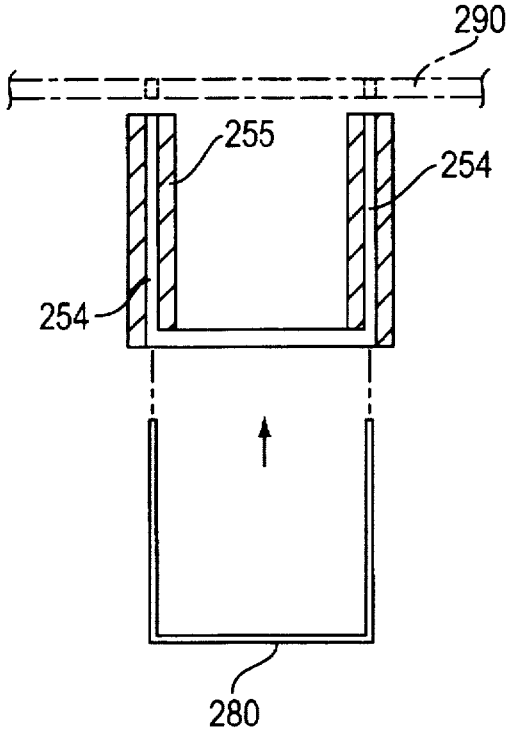
FIG. 8 is a front cross sectional view showing a state that the synchronous cable is coupled on a low voltage bobbin of FIG. 7.

On the other hand, FIG. 7 and FIG. 8 is views showing the synchronous cable coupling device of FBT in accordance with still other embodiment of the present invention.

The structure is made by a structure such that an arc shaped terminal portions 255 perforated with synchronous cable pin inserting holes 254 are projected and fixed to forward of pin terminal portions 253 provided with terminal pins 252 on low voltage bobbin 251 of FBT 250, both ends of synchronous cable pins 280 contacted with the arc shaped terminal portions 255 are made to be internally inserted into interior of the synchronous cable pin inserting holes 254 of the arc shaped terminal portions 255, and the synchronous cable pins 280 are integrally coupled on the PCB 290 with terminal pins 252 of the low voltage bobbin 251.

In accordance with the synchronous cable coupling device having a structure as above, the arc shaped terminal portions 255 perforated with synchronous cable pin inserting holes 254 are provided at forward of the pin terminal portion 253 provided with terminal pins 252 of the low voltage bobbins 251 internally inserted to FBT 250 whereby the synchronous cable pins 280 are inserted thereto.

The arc shaped terminal portions 255 provided to forward both sides of the low voltage bobbins 251 are inserted with U-shaped synchronous cable pins 280 executing a role of synchronous cable within interior of the synchronous cable pin inserting holes 254 perforated to inner side thereof as shown in FIG. 8 so as to be firmly fixed, and then the synchronous cable pins 280 are made to be integrally coupled on PCB 280 with terminal pins 252 of the low voltage bobbin 251 upon assembling a set, so that the electronic wave generated from FBT 250 can be easily absorbed to the synchronous cable 280.

At this moment, the synchronous cable pins 280 are made such that downward bottom surface portion of the ferrite core 260 provided to exterior side of the low voltage bobbin 251 contacts with passing through in a state of pressing the synchronous cable pins 280 upon coupling this to interior of the synchronous cable pin inserting holes 254, so that the synchronous signal can be effectively transferred.

According to this, a coupling of the synchronous cable can be completed by a simple and easy operation inserting the synchronous cable pins 280 into interior of the synchronous cable pin inserting holes 254 of the arc shaped terminal portions 255 integrally made to both sides of the low voltage bobbin 251 upon manufacturing of low voltage bobbin 251.

Thus, in accordance with the synchronous cable coupling device of FBT according to the present invention, a frequency of an induced voltage generated from FBT is made to be stably drawn out, and even without either connecting a separate synchronous cable on the FBT ferrite core for absorbing the electronic wave according to the synchronous signal of FBT or providing a shield metal, and either the synchronous terminal piece executing a synchronous cable role is inserted into the terminal receiving means, or not only the synchronous cable is made to be able to simply and easily provide by a simple operation providing the synchronous cable pins, but also the coupling operation of the synchronous cable is automatized whereby a workability and productivity can be improved, and particularly there is excellent effect capable of further more effectively coinciding the frequency of synchronous signal of a set and the operating frequency of FBT.

Although the present invention is shown and described in relation to particular embodiments, it should be noted that those who has ordinary knowledge in this art can easily know that the present invention may be variously changed and modified within an extent without getting out a spirit or field of the invention provided by following claims.

What is claimed is:

1. An improved flyback transformer (FBT) apparatus, in which an insulating epoxy resin is filled and molded between a high voltage bobbin and a low voltage bobbin and a case, the high and low voltage bobbins being wound with respective coils and operatively disposed with a "C"-shaped ferrite core inserted through the coils and fixed with predetermined gaps at the top and bottom of the case, wherein the improvement comprises:

a synchronous cable coupling device comprising a terminal receiving element, in which coupling holes are defined so as to be coupled with corresponding coupling portions of the low voltage bobbin, in which a core inserting opening is defined within which an external portion of the ferrite core is located, and in which a terminal inserting groove is defined;

a synchronous terminal element comprising a plurality of terminal pins and formed to be inserted into the terminal inserting groove; and a supporting bracket supported to the terminal receiving element, provided with a plurality of holes to receive therein respective ones of the terminal pins when the synchronous terminal element is fitted into the terminal receiving groove, whereby the synchronous cable coupling device is securely supported and fixed to the FBT.

2. The apparatus according to claim 1, wherein:

said synchronous terminal element is formed to have a cut out portion at one side to facilitate said insertion into the terminal receiving groove.

3. The apparatus according to claim 1, wherein:

said terminal receiving element and said case of the FBT are made of the same insulating material.

4. The apparatus according to claim 1, wherein:

said synchronous terminal element is made of a conductive material.

5. The apparatus according to claim 1, wherein:

an external surface gap is defined between said ferrite core and a surrounding surface of the core opening of said terminal receiving element.

* * * * *